US005115110A

United States Patent [19]

Tucker et al.

[11] Patent Number: 5,115,110

[45] Date of Patent: May 19, 1992

[54] HYDRAULIC QUICK CHANGE CLAMP

[75] Inventors: Jerome E. Tucker, Capac; Henry Dykstra, Milford, both of Mich.

[73] Assignee: Delaware Capital Formation, Inc., Wilmington, Del.

[21] Appl. No.: 539,797

[22] Filed: Jun. 18, 1990

[51] Int. Cl.[5] ..... H05B 6/64

[52] U.S. Cl. ..... 219/10.67; 219/10.75; 219/10.79; 269/32; 269/157; 24/455

[58] Field of Search ..... 219/10.67, 10.75, 10.79, 219/10.491; 269/32, 238, 239, 27, 24, 93, 33, 94, 234, 132, 157; 24/455

[56] References Cited

U.S. PATENT DOCUMENTS

| | | | |
|---|---|---|---|
| 4,728,760 | 3/1988 | Brolin et al. | 219/10.79 |
| 4,830,349 | 5/1989 | Miyata | 269/32 |
| 4,905,973 | 3/1990 | Blatt | 269/32 |
| 4,909,493 | 3/1990 | Yonezawa | 269/32 |
| 4,948,105 | 8/1990 | Yonezawa | 269/32 |
| 4,982,939 | 1/1991 | Yoshikawa et al. | 269/32 |

*Primary Examiner*—Bruce A. Reynolds
*Assistant Examiner*—Tu Hoang
*Attorney, Agent, or Firm*—Lloyd M. Forster; Michael R. Dinnin

[57] ABSTRACT

Hydraulically actuated quick release base mounted clamp particularly capable of use for clamping interchangeable production heat treating induction coils to produce intimate pressurized electrical conductive contact between elongated base mounted and induction coil bus bars. A central short stroke hydraulic cylinder produces only slight pivotal clamping engagement of dual laterally spaced clamp arms, the pivots of which can be linearly laterally retracted to clearance position upon release of hydraulic pressure. A cross shaft having a flatted engagement by the rigidly mounted cylinder piston head and a pivot cross shaft having flatted ends adapted to slide in slotted keyways upon release of actuating pressure provide for lateral movement of the clamp arm assembly to a clearance position while the actuating cylinder remains in its fixed position.

23 Claims, 3 Drawing Sheets

HYDRAULIC QUICK CHANGE CLAMP

BACKGROUND OF THE INVENTION

Induction coils employed in heat treating production parts are clamped in a fixture with copper bus bar connections, designated as "fishtails" in the art, which are elongated and required to conduct high amperage. This in turn requires intimate contact under clamping pressure. When a change of induction coil is involved in converting to different size or shape of work piece to be heat treated, conventional practice has involved unscrewing clamp elements which have held the fixture and induction coil bus bars in required intimate contact. This has been standard practice, notwithstanding the identity of the induction coil terminal bus bars per se, which would facilitate standard clamping means.

BRIEF SUMMARY OF THE PRESENT INVENTION

Conservation of space available for fixturized clamping of induction coils, together with desirability for achieving quick change for electrical connection of different induction coils to the base fixture, has been met by the present hydraulic cylinder actuated clamping means having dual clamp arms actuated by a cross shaft with a common pivot cross shaft having ends seated in a pair of clamp base uprights, each respectively slotted with a linear reaction keyway accommodating lateral slide retraction of the pivot cross shaft and clamp arms upon release of hydraulic pressure. A rigidly mounted compact short stroke hydraulic cylinder is adapted to actuate the clamp arm cross shaft with area contact on a flatted surface of a generally cylindrical shaft having a cylindrical bearing connection with the dual clamp arms. Flatted ends, seated on the slide keyways, of a generally cylindrical reaction pivot cross shaft provides cylindrical bearing surface for the slight pivotal actuation of the dual clamp arms in applying clamping pressure while accommodating lateral retraction of the pivot shaft and clamp arms to a clearance position for coil bus bar removed upon release of hydraulic pressure.

DETAILED DESCRIPTION OF FIRST EMBODIMENT

Figure 1:
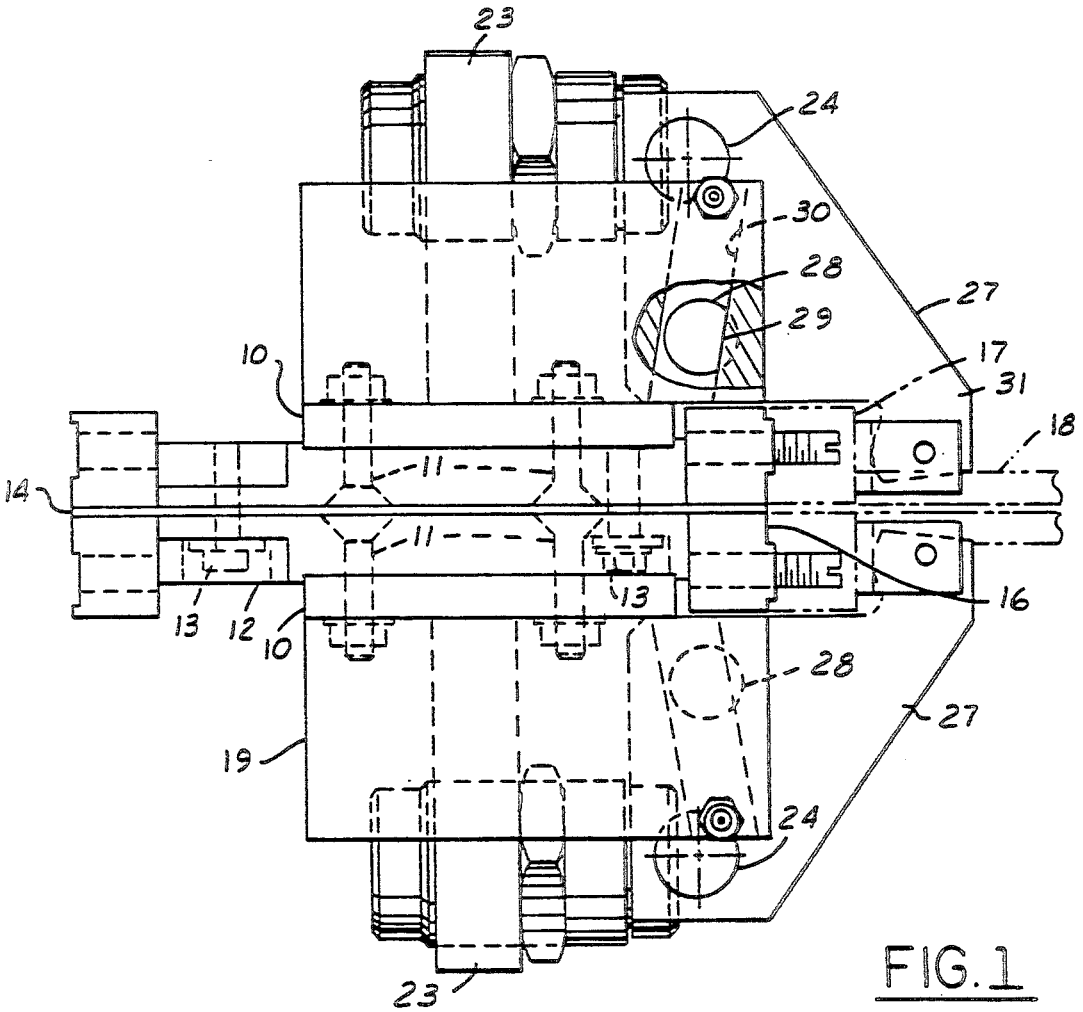
FIG. 1 is a side elevation of an induction coil clamping fixture employing the quick change hydraulic clamping assembly of the present invention.
Figure 2:
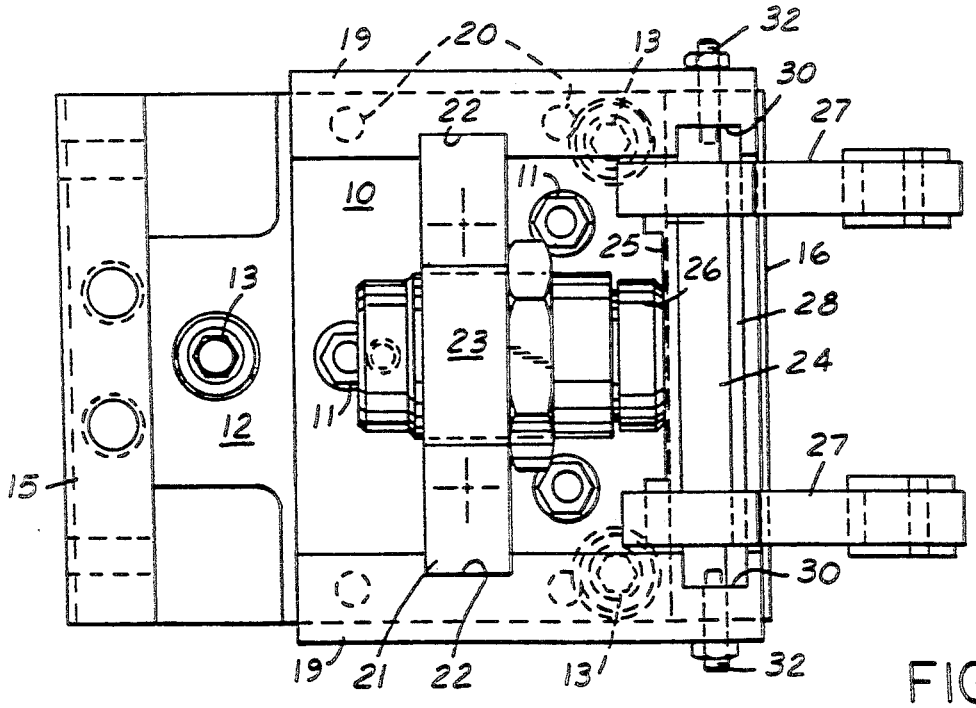
FIG. 2 is an end elevation of the fixture illustrated in FIG. 1.
Figure 3:
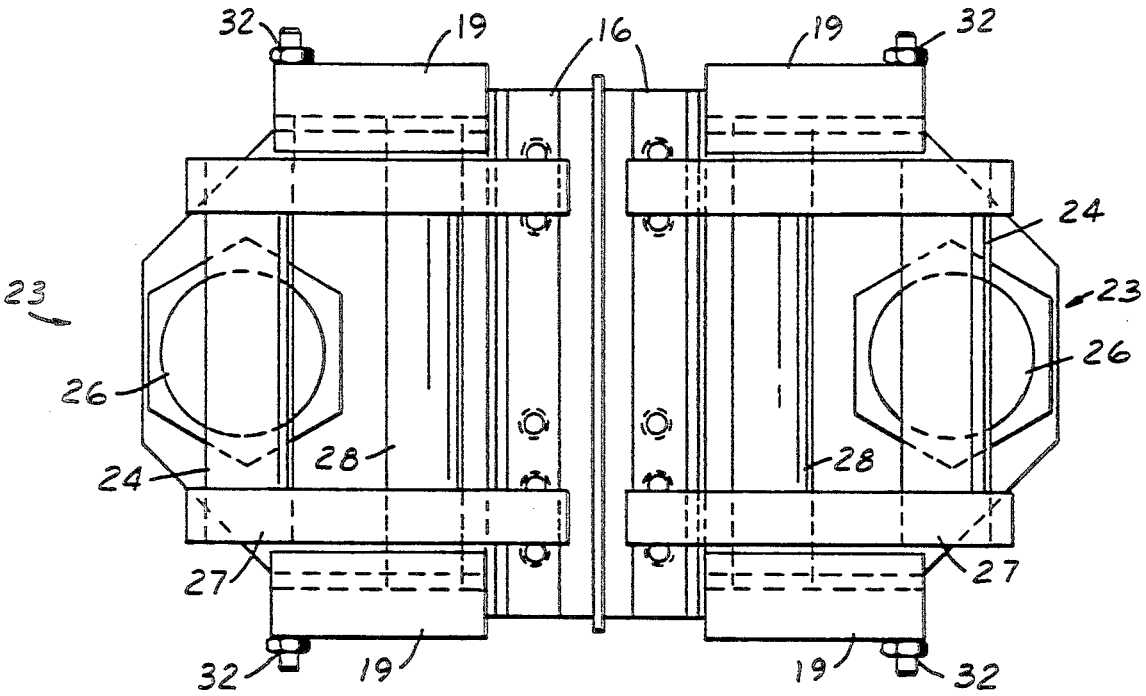
FIG. 3 is a plan view of the fixture illustrated in FIG. 1.

With reference to FIGS. 1-3, a pair of steel clamp base plates 10 are connected by flathead screws 11 to a pair of copper gussets 12 secured together by three brass screws 13 with a teflon insulator 14 therebetween. Each gusset 12 is provided with a copper bus bar "fishtail" 15 at one end adapted for connection to an electrical power source and to a similar bus bar 16 at the other end for removable coupling to a matching elongated copper induction coil bus bar 17, each provided with electrical lead 18 to an induction coil employed for production heat treating.

Each base plate 10 is provided with a pair of normally related clamp plates 19 secured by appropriate machine screws, not shown, on centers 20. Cylinder mounting plate 21 is secured on each base plate 10 between clamp plates 19 with slotted engagement at 22 to provide reaction for hydraulic cylinder 23 rigidly mounted on cylinder mounting plate 21. Cross shaft 24 having flatted surface 25 engaged by cylinder piston head 26 actuates a pair of clamp arms 27 pivotally mounted on cross shaft 28 having flatted ends 29 engaging slotted angled keyways 30 whereby pivot reaction at the location illustrated will serve as a fixed reaction for applying clamping pressure to clamping ends 31 for establishing intimate electrical contact pressure engagement of induction coil "fishtail" bus bar 15 with electrical supply conducting fixture bus bar 16.

As best shown in FIG. 3, this arrangement accommodates, upon release of hydraulic pressure, lateral sliding of each cross shaft 28 with its pair of clamp arms 27 along keyway 30 for movement of the clamp arms to a clearance position in order to facilitate installation of a different induction coil, and then back to clamping position as illustrated after positioning the new coil fishtails into preliminary engaging relation whereupon hydraulic actuation of cylinders 23 will effect required clamping pressure. Flatted area engagement between piston head 26 and cross shaft 24, cylindrical bearing engagement between cross shaft 24 and clamp arms 27, area flat reaction engagement between ends of cross shaft 28 and keyways 30, and cylindrical pivotal engagement between shaft 28 and clamp arms 27, permit high clamping force provided by cylinder pressures in the order of 3000 p.s.i. without undue unit bearing pressures.

DETAILED DESCRIPTION OF SECOND EMBODIMENT

Figure 5:
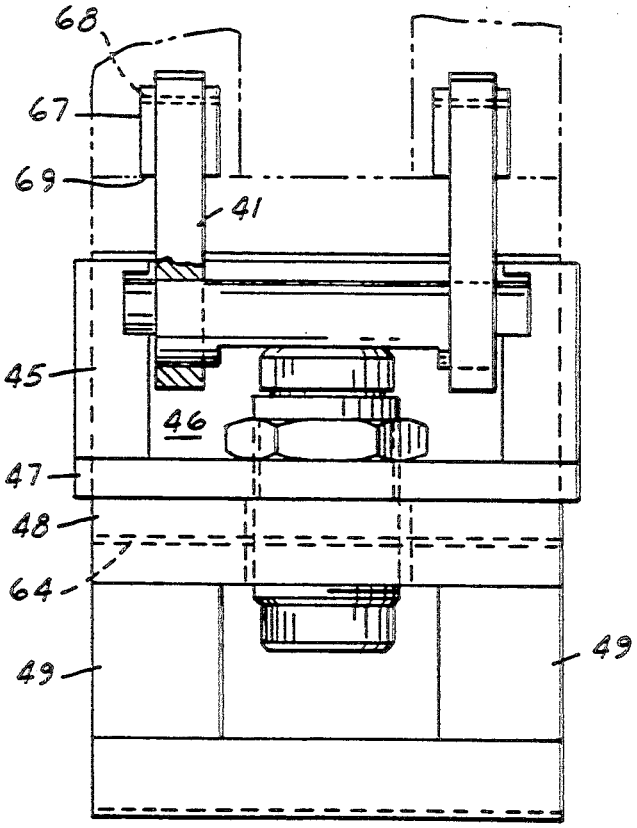
FIG. 5 is an end view of the FIG. 4 embodiment.
Figure 4:
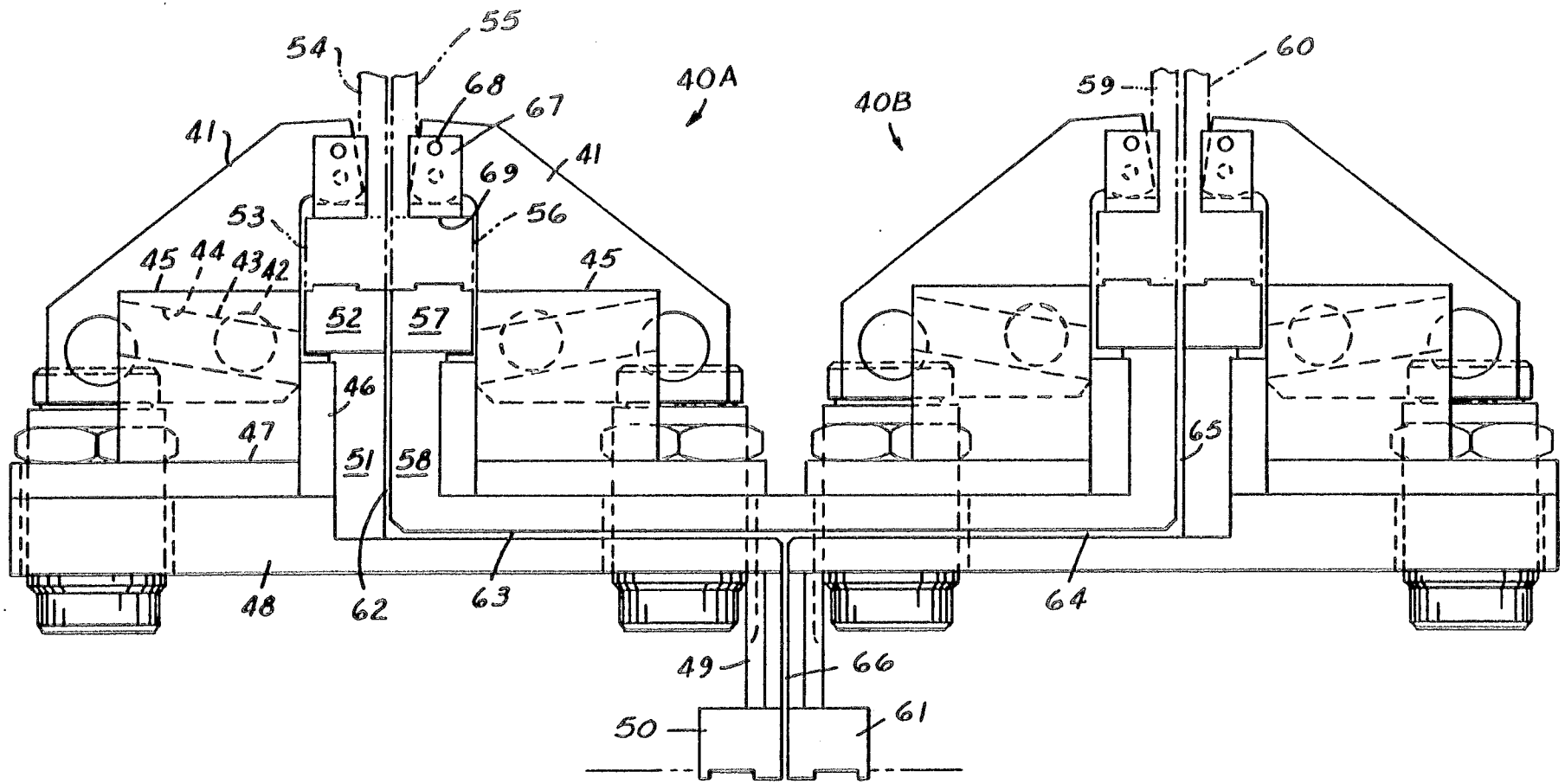
FIG. 4 is a side view of a modified installation for two induction coils.

With reference to FIGS. 4 and 5, a dual induction coil installation is illustrated with a pair of clamping assemblies 40A and 40B, each employing clamping provisions similar to the first embodiment and comprising identical mirror image units.

Each clamping arm assembly includes steel clamp arms 41, having steel pivot cross shafts 42 flatted at the ends 43 engaging slotted angled keyways 44 in steel clamp plates 45 projecting from steel base plates 46. Steel cylinder mounting plate 47 is secured to base plate 46 and supported on copper end plate 48, which extends to the center of the dual assembly for connection through a pair of copper connector plates 49 to copper supply bus bar 50 with identical provisions for each of the units 40A and 40B.

This arrangement will be seen to provide a series path from copper supply bus bar on one side through copper connector 49, end plate 48, copper gusset 51, bus bar 52, induction coil bus bar 53, induction coil lead 54, return lead 55, coil bus bar 56 and fixture bus bar 57 to a common copper bridging conductor 58 providing a like circuit to leads 59 and 60 of the second clamping assembly 40B and supply bus bar 61. Insulation provided at 62, 63, 64, 65 and 66 provides required separation for the complete series electrical circuit through both induction coils.

In order to provide area clamping contact with each of induction coil bus bars, such as 53 and 56, clevis clamp pads 67 pivotally connected to clamp arm ends at 68 have planar surfaces 69 protecting the induction coil bus bars against excessive unit pressures.

It will be understood that structural support for each of the clamping assemblies 40A and 40B may be added where necessary for particular installations, depending on the size and the weight of the coils and their positioning, especially with respect to overhang loads. Optionally, base plate 10, clamp plates 19 and cylinder mounting plate 21 could be made of a single piece casting.

In both embodiments, the provision of angled keyways 30, 44 will be seen to accommodate a short stroke rigidly mounted cylinder with lateral movement of the clamp arms 27, 41 to clearance position with minimal space requirement as compared to conventional power actuated pivoted clamp arm insulations. While the disclosure illustrates particular adaptations of the clamp assembly to specific requirements for interchangeable induction coil clamping, it will be understood that novel aspects of the clamp assembly have numerous other appropriate applications where linear movement of the clamp arm to a clearance position upon release of clamping pressure may be more suitable for limited space configurations than conventional swinging arm clamps.

We claim:

1. Clamp for releasably clamping interchangeable articles on a fixed base comprising, a fixed base, clamp arm means for article clamping engagement, pivotal mounting means on the base for said arm means, means on the base to produce releasable article clamping actuation of said arm means in a direction for clamping engagement characterized by, means on said base for accommodating movement of said pivotal mounting means together with said arm means to a relative clearance position for said articles upon release of said clamping actuation.

2. Clamp of claim 1 including linear means accommodating retraction of said pivotal and arm means to a clearance position for said arm means.

3. Clamp of claim 2 wherein said means for accommodating retraction includes a linear path extending laterally relative to the direction of clamping engagement.

4. Clamp of claim 3 wherein said means for accommodating retraction includes linear keyway mounting for ends of said pivotal mounting means.

5. Clamp of claim 4 wherein said pivotal mounting means includes a cylindrical shaft with flatted ends for an area reaction keyway engagement during pivotal clamp actuation.

6. Clamp of claim 1 including fixed cylinder means for clamping actuation.

7. Clamp of claim 6 including an area contact actuating engagement.

8. Clamp of claim 7 including dual clamp arms having cross shaft actuation applied by central cylinder means.

9. Clamp of any of claims 1–8 with means for clamping an induction coil bus bar to a fixed electrical bus bar.

10. Clamp of claim 9 including a pair of said clamps for clamping a pair of induction coil bus bars to a pair of fixed electrical supply bus bars.

11. Clamp of claim 10 including two pairs of said clamps for clamping two pairs of induction coil bus bars to a pair of fixed electrical supply bus bars.

12. Clamp of claim 11 including means for providing a series electrical circuit from one supply bus bar through both induction coils bus bars to the other supply bus bar.

13. Clamp of claim 12 employing a pair of clamp arms for clamping each induction coil bus bar with a central rigidly mounted actuating cylinder.

14. Clamp of claim 13 including a common conducting bridge member for the two induction coil bus bar clamping units.

15. An induction heating-clamp apparatus for releasably clamping interchangeable articles on a fixed base comprising, a fixed base, clamp arm means for article clamping engagement, pivotal mounting means on the base for said arm means, means on the base to produce releasable article clamping actuation of said arm means in a direction for clamping engagement characterized by, means on said base for accommodating movement of said pivotal mounting means together with said arm means to a relative clearance position for said articles upon release of said clamping position.

16. The invention of claim 15 including linear means accommodating retraction of said pivotal mounting means and arm means to a clearance position for said arm means, and wherein said means for accommodating retraction includes a linear path extending laterally relative to the direction of clamping engagement, and wherein said means for accommodating retraction includes a linear keyway mounting for ends of said pivotal mounting means, and wherein said pivotal mounting means includes a cylindrical shaft with flatted ends for an area reaction keyway engagement during pivotal clamp actuation, and including fixed cylinder means for clamping actuation.

17. The invention of claim 16 including area contact actuating engagement.

18. The invention of any of claims 15–17 with means for clamping an induction coil bus bar to a fixed electrical bus bar.

19. The invention of claim 18 including a pair of said clamps for clamping a pair of induction coil bus bars to a pair of fixed electrical supply bus bars.

20. The invention of claim 19 including two pairs of said clamps for clamping two pairs of induction coils bus bars to a pair of fixed electrical supply bus bars.

21. The invention of claim 20 including means for providing a series electrical circuit from one supply bus bar through both induction coils bus bars to the other supply bus bar.

22. The invention of claim 21 employing a pair of clamp arms for clamping each induction coil bus bar with a central rigidly mounted actuating cylinder.

23. The invention of claim 22 including a common conducting bridge member for the two induction coil bus bar clamping units.

* * * * *